US007849616B2

(12) United States Patent
Bolton

(10) Patent No.: US 7,849,616 B2
(45) Date of Patent: Dec. 14, 2010

(54) LOCKDOWN SHADE

(76) Inventor: Robert E. Bolton, 1087 Kinmouth Dr., Joliet, IL (US) 60433

( * ) Notice: Subject to any disclaimer, the term of this patent is extended or adjusted under 35 U.S.C. 154(b) by 105 days.

(21) Appl. No.: 12/318,111

(22) Filed: Dec. 22, 2008

(65) Prior Publication Data

US 2010/0155001 A1 Jun. 24, 2010

(51) Int. Cl.
*G09F 7/04* (2006.01)

(52) U.S. Cl. ..... 40/600; 40/593; 49/70; 160/10

(58) Field of Classification Search ..... 40/600; 160/10, 370, 21, 127, 368.1, DIG. 16; 52/202, 52/206, DIG. 4, DIG. 13; 49/70
See application file for complete search history.

(56) References Cited

U.S. PATENT DOCUMENTS 2,350,617 A * 6/1944 Johnson ..... 160/90
4,079,772 A 3/1978 Klaenhammer et al.
4,703,575 A * 11/1987 Diamond ..... 40/600
5,156,274 A * 10/1992 Williams et al. ..... 206/573
6,865,850 B1 * 3/2005 Campbell ..... 52/202
6,912,805 B2 7/2005 Ngan
7,320,353 B1 * 1/2008 Miller et al. ..... 160/89
2004/0050507 A1 * 3/2004 Thomas ..... 160/368.1
2005/0022439 A1 2/2005 Crump

* cited by examiner

*Primary Examiner*—Lesley Morris
*Assistant Examiner*—Kristina Staley
(74) *Attorney, Agent, or Firm*—Richard C. Litman

(57) ABSTRACT

The lockdown shade is a device for preventing visual access to an area through a window of a door. The device has a shade normally stored on a mounting system that is positioned on a wall surface adjacent to the door window. The shade is fabricated from a solid, opaque material having fastener(s) on its rear surface to effect quick and easy attachment to the door window. The fastener(s) also function to provide attachment to the mounting system. The shade is configured and dimensioned to cover the window in the door.

8 Claims, 5 Drawing Sheets

LOCKDOWN SHADE

BACKGROUND OF THE INVENTION

1. Field of the Invention

The present invention generally relates to security devices, and particularly to a lockdown shade that can be placed over a window in a door during a security lockdown for preventing an outsider from viewing a room through a door window or the like, and may include a visual indicator to indicate at a glance the status of the room's occupants.

2. Description of the Related Art

Unfortunately, it has become necessary to provide for special security procedures in public and private institutions, such as schools and office buildings. The security procedures are needed to protect personnel and/or students in the event of accidental or natural emergencies and/or in the event of criminal or terrorist behavior. Such procedures, if properly and efficiently utilized, can minimize the occurrence of injury and loss of life.

One widely employed security procedure is known as the "lockdown". Lockdowns and lockdown drills have been frequently implemented and practiced in schools and office facilities in the wake of highly publicized shootings. During a lockdown, normal traffic or movement through the facility is prohibited or greatly restricted. In certain emergencies, or in particular implementations, lockdown procedures may require that a particular area (classroom, office, etc.) be visually cut off from the outside. This requires that means are needed to quickly shade a normally unshaded window in a door to prevent visual access to the area from outside the area. Normally, conventional office or classroom door windows (especially narrow door windows) are not provided with shades that would prevent such visual access. The security sector would certainly welcome a device to easily and quickly prevent such visual access when necessary. Thus, a lockdown shade solving the aforementioned problems is desired.

SUMMARY OF THE INVENTION

The lockdown shade is a device for preventing visual access to an area through a window in a door. The device comprises a shade normally stored on a mounting system that permits temporarily mounting the shade on a wall surface adjacent to the door window when not in use. The shade is fabricated from a solid, opaque material, and has fastening means on its rear surface to effect quick and easy attachment to the door window. The fastening means also function to provide attachment to the mounting system. The shade is configured and dimensioned to cover the window in the door.

Accordingly, the invention presents a device to afford quick and easy visual security for an area during a lock down procedure. The device is readily accessed from a storage position and is designed to be unobtrusive while in the storage position. The invention includes means for indicating the status of personnel in the secured area. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
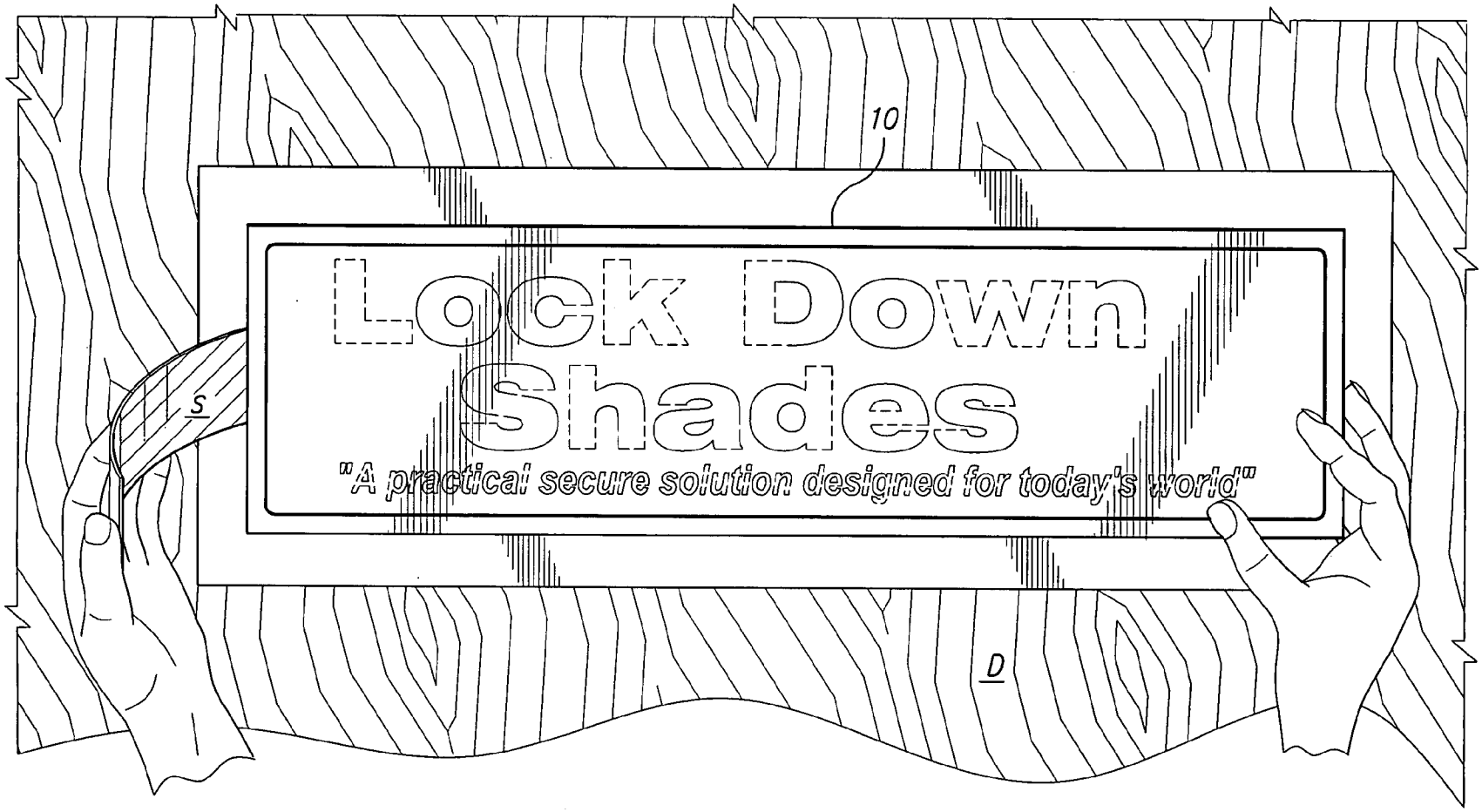
FIG. 1 is an environmental, perspective view of an exemplary embodiment of a lockdown shade according to the present invention, shown in an operative position.

Attention is first directed to FIG. 1, wherein an exemplary lockdown shade of the present invention is generally indicated at 10. Shade 10 is mounted over the window of a door D. Door D defines the entrance/exit of an area, such as a classroom or an office. The shade 10 is disposed on the door D from inside the area and prohibits anyone outside the area from looking through the window into the area during a lockdown procedure. A status strip S, whose function is explained below, is inserted in a space between the shade 10 and the window.

Figure 2:
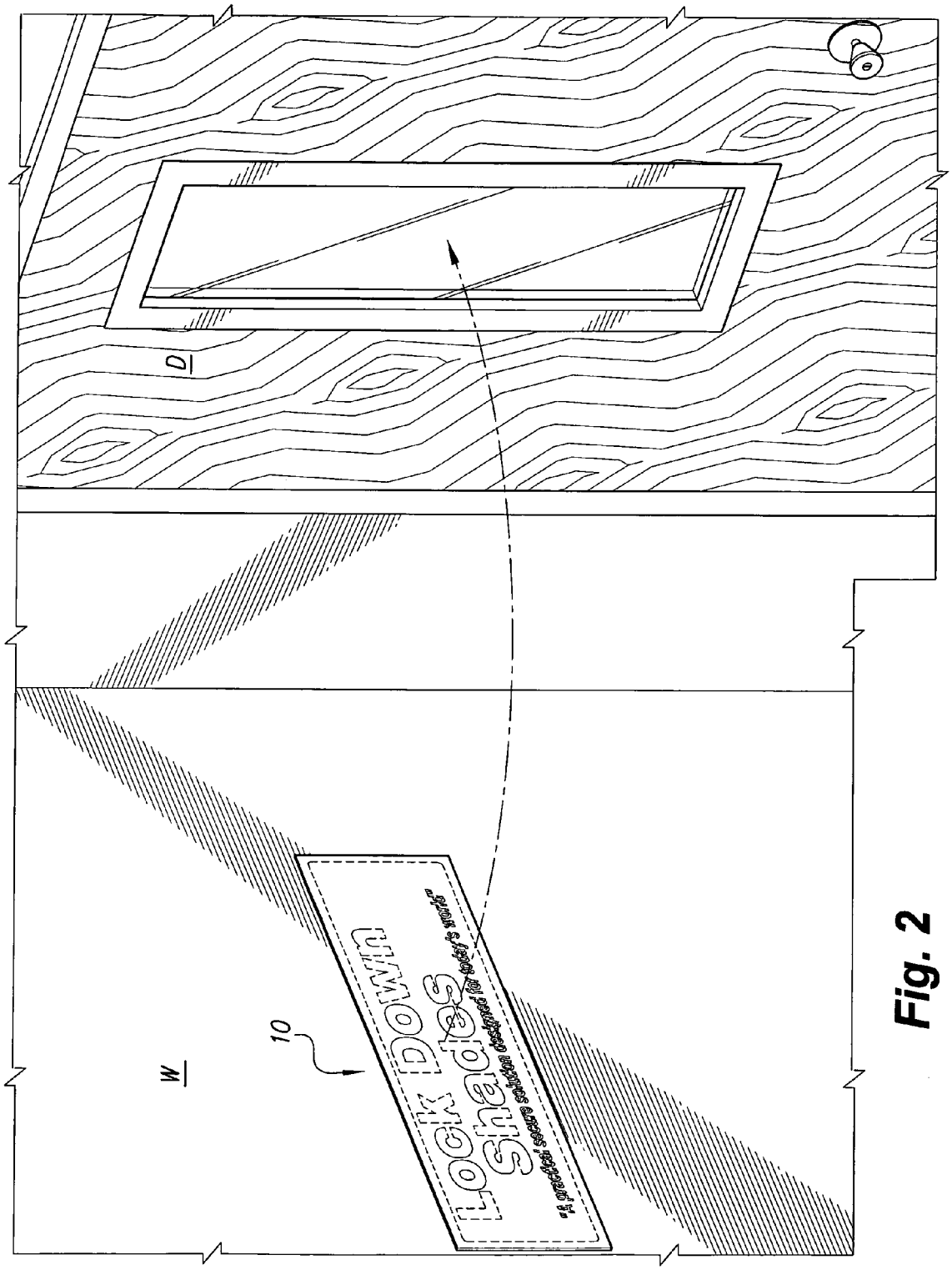
FIG. 2 is an environmental, perspective view of the lockdown shade of FIG. 1, shown in a storage position.

FIG. 2 shows an example of the shade 10 mounted in a storage position on a wall W adjacent door D. This positioning allows easy access to the shade 10 for mounting over the door window should a lockdown occur.

Figure 3:
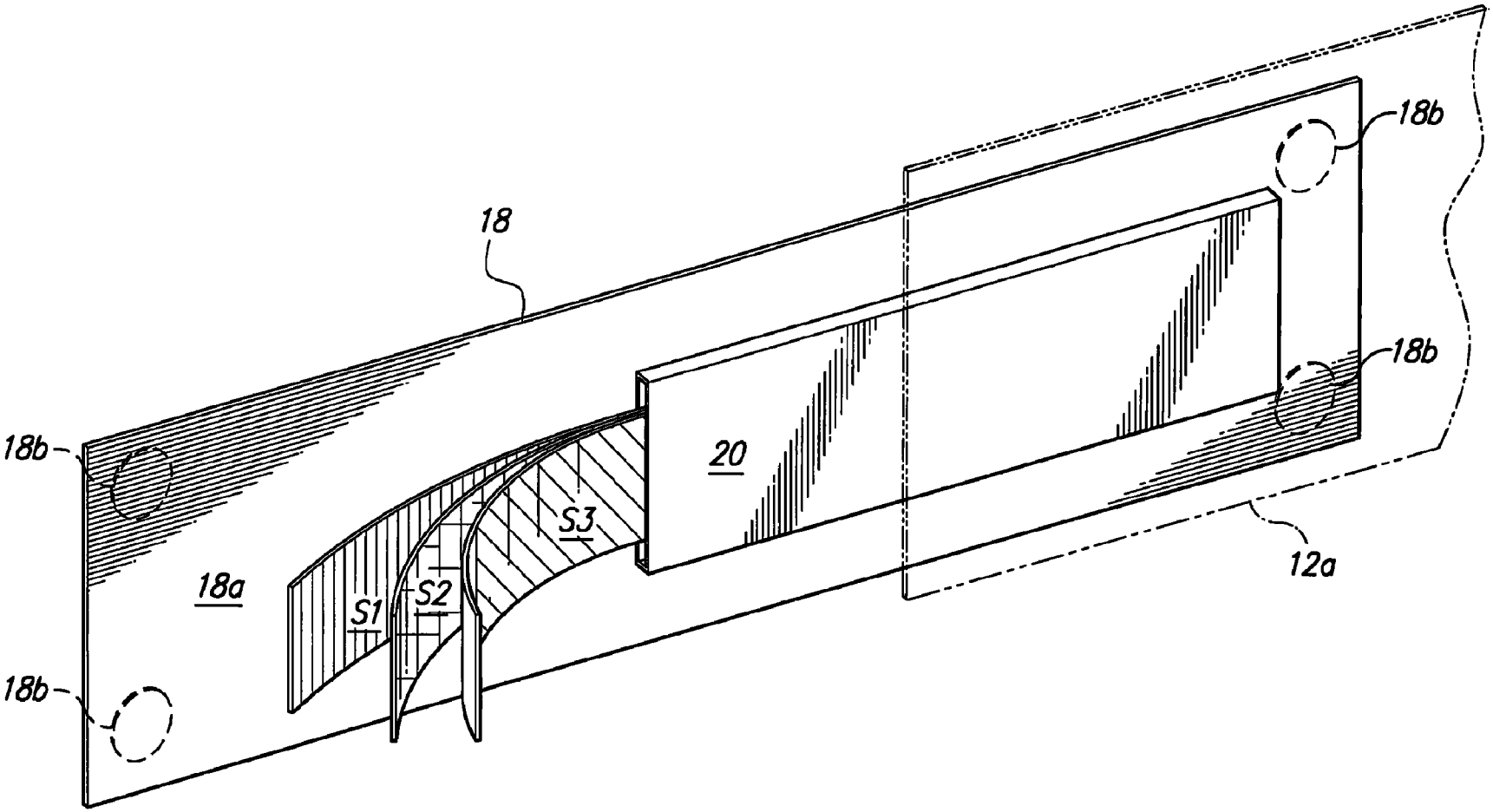
FIG. 3 is an exploded, perspective view of a wall mount for a lockdown shade according to the present invention.
Figure 4:
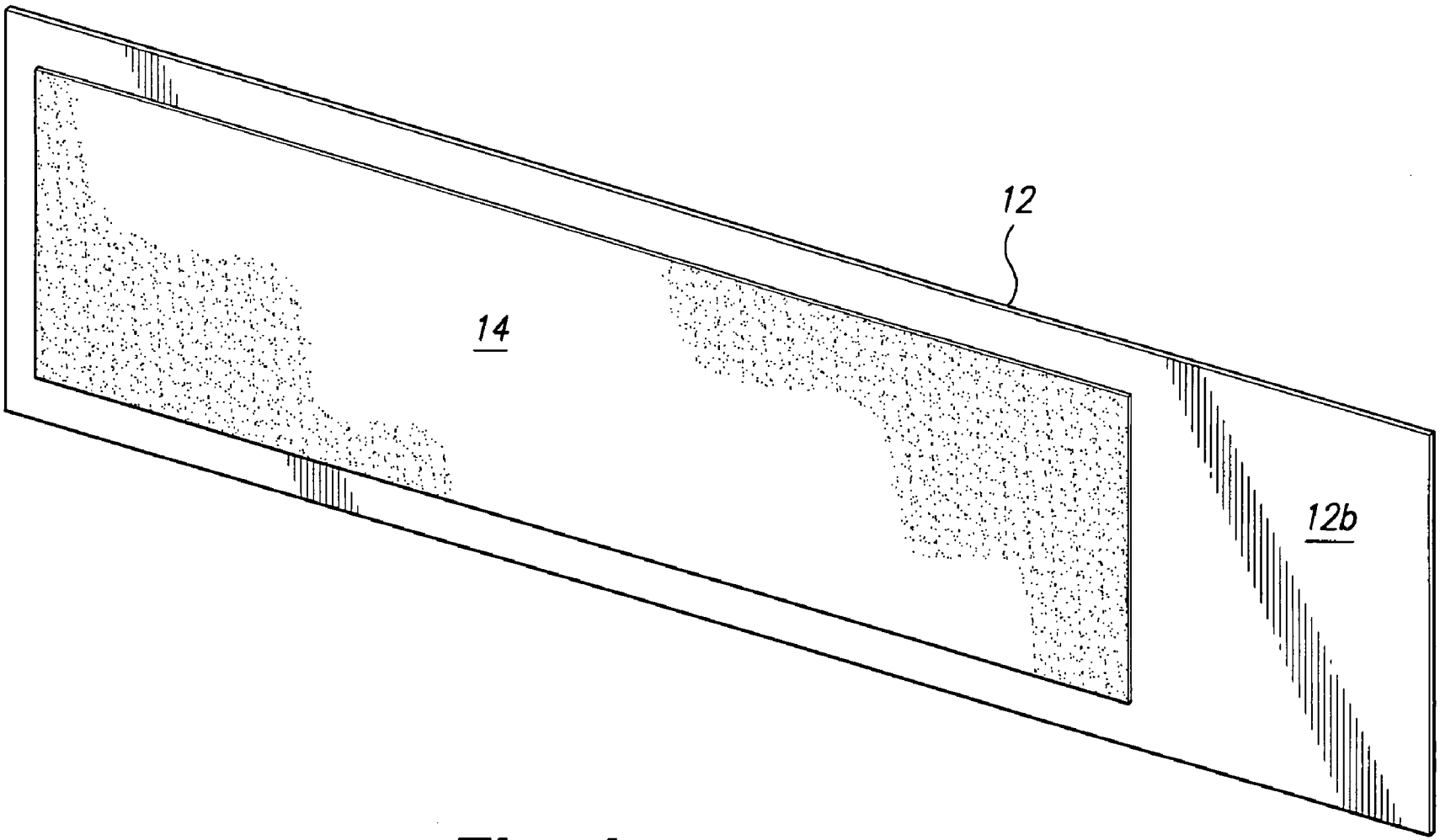
FIG. 4 is a rear view of a first embodiment of a lockdown shade according to the present invention.
Figure 5:
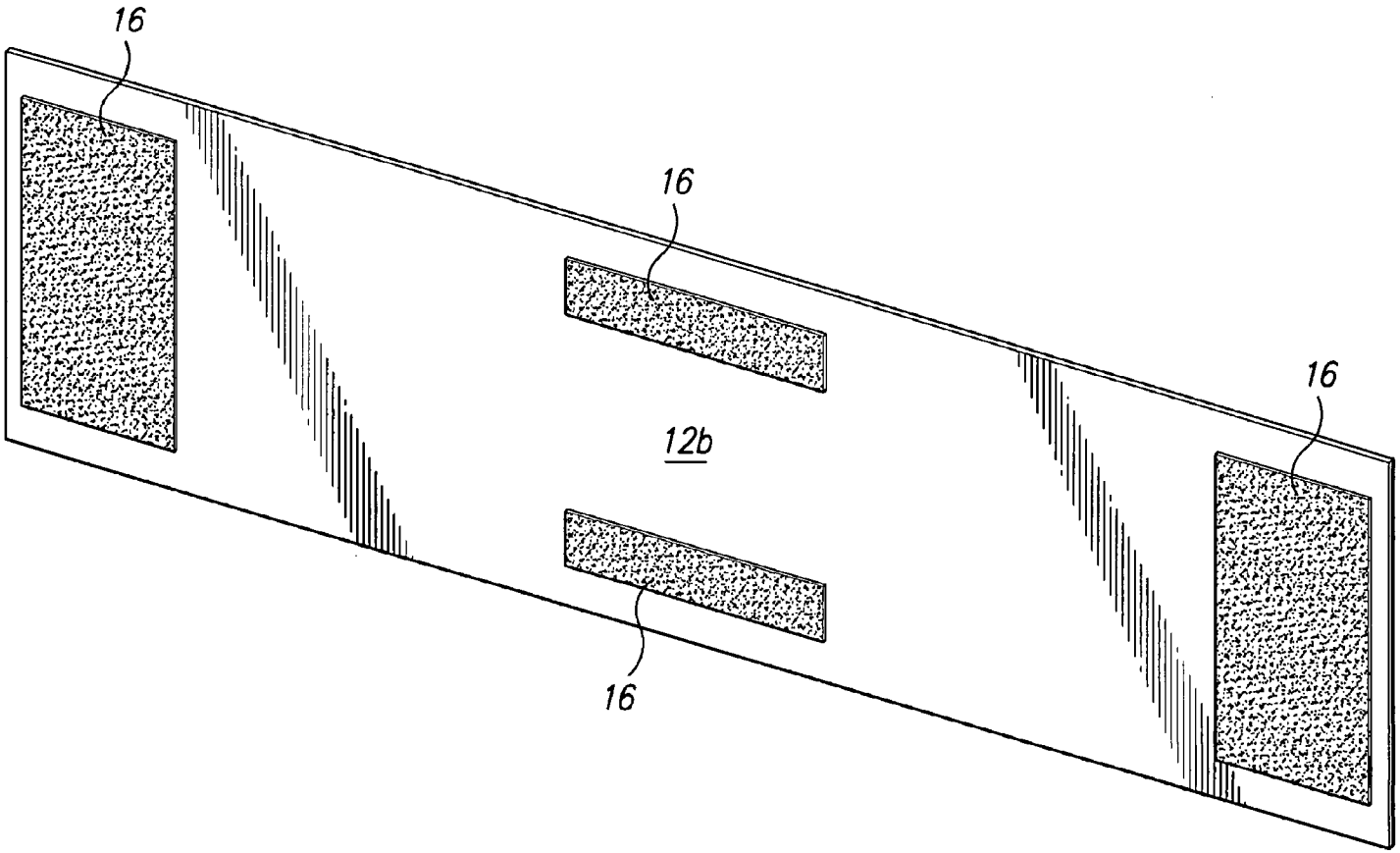
FIG. 5 is a rear view of a second embodiment of a lockdown shade according to the present invention.

As best seen in FIGS. 3-5, the lockdown shade 10 comprises a body member 12 having front face 12*a* and a rear face 12*b*. Front face 12*a* may be inscribed with printed matter or the like (slogans, information or other suitable matter). The front face 12*a* can also take the form of a blackboard, whiteboard, or other surface upon which a status word may be inscribed, if desired. The object is to make the body member as unobtrusive as possible when in its storage position. Body member 12 is fabricated from a rigid lightweight material, such as paperboard, foam board, or medium density fiberboard.

In one embodiment of the invention, shown in FIG. 4, a thin magnetic sheet 14 is disposed on rear face 12*b*. Sheet 14 does not extend the full length of body member 12 for reasons as will be explained below. In a second embodiment, shown in FIG. 5, hook and loop fasteners 16 are strategically arranged on the rear face 12*b* of body member 12. A mounting member 18 is attached to the wall W by any suitable means. Mounting member 18 has its front surface covered with a ferromagnetic sheet 18*a*. Ferromagnetic sheet 18*a* may be sheet metal, plastic "paper steel," or any other material capable of having a magnet attached thereto, and may be coextensive with magnetic sheet 14. Alternatively, instead of the magnetic sheet, hook and loop fasteners 18*b* (shown in phantom lines) can be strategically positioned on the front surface to interface with hook and loop fasteners 16. Body member 12 preferably has sufficient thickness that the user does not need to fumble around attempting to peel a thin sheet from the mounting member 18, but may remove the shade 10 from mounting member 18 and apply it to door D quickly in an emergency. The front face 12*a* of body 12 may have a vinyl layer laminated to a thicker paperboard, foam board, or fiberboard substrate, if desired.

A storage pocket 20 is mounted on the front surface of mounting member 18. Color-coded status strips (S1, S2, S3) are housed in the storage pocket 20. Alternatively, the status strips S1, S2, and S3 may themselves have a magnetic surface for attachment the front surface of mounting member 18, or may be retained on mounting member 18 by any other releasable fastener that permits quickly detaching the status strips S1, S2, and S3 from the mounting member 18 for rapid deployment with the shade 10. The color of the status strip will indicate at a glance the condition of the personnel in the area, or the status of accessibility to the room during the lockdown. For example a green strip may indicate that all are safe, yellow may indicate that some are injured, etc. Alternatively, green may indicate the room is freely accessible to all needing safe haven, yellow may indicate limited access, red may mean positively no access permitted until the lockdown is lifted, etc.

The width of mounting member 18 may be slightly less than the width of body member 12 to present a grasping edge that enhances removal of body member 12 from the mounting member.

In use, if the door window to be covered has a metal frame, the system that utilizes magnetic attachment can be employed, since the magnetic sheet 14 can attach to portions of the door D framing the window. Since the magnetic sheet 14 does not extend completely to the top of member 12, a slot or gap is formed at the top allowing a status strip to be slipped between the window and the shade 10. If the door window to be covered has a wooden frame, the system that utilizes hook and loop fasteners would be employed. In this instance, mating hook and loop fasteners would be pre-positioned on the door D around the perimeter of the window. Alternatively, any other releasable fastener may be used to alternately attach the shade 10 to the frame of the door D to cover the window during lockdowns, or to the mounting member 18 on the wall W for storage when not in use.

It is to be understood that the present invention is not limited to the embodiments described above, but encompasses any and all embodiments within the scope of the following claims.

I claim:

1. A lockdown shade security apparatus, comprising:

a shade member adapted to be positioned over a window of a door during a lockdown, the shade member having a front face, a rear face, a width, and a length;

a mounting member for supporting said shade member at a position adjacent the door, the mounting member having a front surface, a width, and a length, wherein at least one of the dimensions is less than the corresponding dimension of the shade member, thereby providing a gripping surface between the shade and mounting members;

means for removably fastening the shade member alternately to the mounting member for storage and to the door to cover the door window during the lockdown, wherein the fastening means is mounted on at least the rear face of the shade member and has a dimension less than a corresponding dimension of the shade member;

a storage pocket member positioned on the front surface of the mounting member; and a plurality of removable status strips housed in the storage pocket member.

2. The lockdown shade security apparatus according to claim 1, wherein said means for removably fastening comprises a magnetic sheet attached to the rear face of said shade member.

3. The lockdown shade security apparatus according to claim 1, wherein said means for removably fastening comprises hook and loop fasteners.

4. The lockdown shade security apparatus according to claim 1, wherein said plurality of removable status strips is color-coded.

5. The lockdown shade security apparatus according to claim 1, wherein said front face of said shade member is inscribed with decorative and informational indicia.

6. The lockdown shade security apparatus according to claim 1, wherein the shade member is fabricated from a lightweight material.

7. The lockdown shade security apparatus according to claim 1, wherein said means for removably fastening includes a magnetic sheet disposed on the rear face of said shade member and a ferromagnetic sheet disposed on the front surface of said mounting member.

8. The lockdown shade security apparatus according to claim 1, wherein said means for removably fastening include:

a magnetic sheet disposed on the rear face of said shade member, the magnetic sheet having a length is less than the length of said shade member; and a ferromagnetic sheet disposed on the front surface of said mounting member, the ferromagnetic sheet having a length coextensive with the length of the magnetic sheet.

* * * * *